US008385556B1

(12) United States Patent
Warner et al.

(10) Patent No.: US 8,385,556 B1
(45) Date of Patent: Feb. 26, 2013

(54) PARAMETRIC STEREO CONVERSION SYSTEM AND METHOD

(75) Inventors: Aaron Warner, Seattle, WA (US); Jeffrey Thompson, Bothell, WA (US); Robert Reams, Mill Creek, WA (US)

(73) Assignee: DTS, Inc., Calabasas, CA (US)

( * ) Notice: Subject to any disclaimer, the term of this patent is extended or adjusted under 35 U.S.C. 154(b) by 1181 days.

(21) Appl. No.: 12/192,404

(22) Filed: Aug. 15, 2008

Related U.S. Application Data

(60) Provisional application No. 60/965,227, filed on Aug. 17, 2007.

(51) Int. Cl.
*H04R 5/00* (2006.01)
*H04R 1/40* (2006.01)

(52) U.S. Cl. ..... 381/23; 381/21; 381/97; 381/106

(58) Field of Classification Search ..... 381/21, 381/23, 97, 106
See application file for complete search history.

(56) References Cited

U.S. PATENT DOCUMENTS

2005/0195995 A1 9/2005 Baumgarte
2006/0029231 A1 2/2006 Henn
2007/0172071 A1 7/2007 Mehrotra
2007/0189551 A1* 8/2007 Kimijima ..... 381/97
2008/0031463 A1 2/2008 Davis et al.
2008/0126104 A1 5/2008 Seefeldt et al.

FOREIGN PATENT DOCUMENTS

WO 03069954 A2 8/2003

OTHER PUBLICATIONS

International search report & written opinion issued in counterpart International (PCT) application No. PCT/US2009/004674; Filed: Aug. 14, 2009.
Article: "On Improving Parametric Stereo Audio Coding", AES Convention Paper 6804 by Jimmy Lapierre and Roch Lefebvre, dated May 20-23, 2006.
European Search Report issued in corresponding European Patent Application No. 09 806 985.9-1224, filed Aug. 14, 2009.

* cited by examiner

*Primary Examiner* — S. V. Clark
*Assistant Examiner* — Jesse Y Miyoshi
(74) *Attorney, Agent, or Firm* — William Johnson

(57) ABSTRACT

A system for generating parametric stereo data from phase modulated stereo data is provided. A phase difference system receives left channel data and right channel data and determines a phase difference between the left channel data and the right channel data. A phase difference weighting system receives the phase difference data and generates weighting data to adjust left channel amplitude data and right channel amplitude data based on the phase difference data. A magnitude modification system adjusts the left channel amplitude data and the right channel amplitude data using the weighting data to eliminate phase data in the left channel data and the right channel data.

5 Claims, 6 Drawing Sheets

$$Y(K) = B_1X(K) + B_2X(K-1) - A_1Y(K-1)$$

600

PARAMETRIC STEREO CONVERSION SYSTEM AND METHOD

RELATED APPLICATIONS

This application claims priority to U.S. provisional application 60/965,227, filed Aug. 17, 2007, entitled "Parametric Stereo Conversion System and Method," which is hereby incorporated by reference for all purposes.

FIELD OF THE INVENTION

The present invention pertains to the field of audio coders, and more particularly to a system and method for conditioning multi-channel audio data having magnitude and phase data so to compensate the magnitude data for changes in the phase data to allow magnitude data only to be transmitted for each channel, without the generation of audio artifacts or other noise that can occur when the phase data is omitted.

BACKGROUND OF THE INVENTION

Multi-channel audio coding techniques that eliminate phase data from audio signals that include phase and magnitude data are known in the art. These techniques include parametric stereo, which uses differences in magnitude between a left channel signal and a right channel signal to be used to simulate stereophonic sound that would normally include phase information. While such parametric stereo does not allow the listener to experience the stereophonic sound with the full depth of field that would be experienced if phase data was also included in the signal, it does provide some depth of field that improves the sound quality over simple monaural sound (such as where the amplitude of each channel is identical).

One problem with converting from multi-channel audio data that includes magnitude and phase data to multi-channel audio data that includes only magnitude data is proper handling of the phase data. If the phase data is simply deleted, then audio artifacts will be generated that cause the resulting magnitude-only data to be unpleasant to the listener. Some systems, such as Advanced Audio Coding (AAC) system, utilize side band information that is used by the receiver to compensate for the elimination of phase data, but such systems require a user to have a special receiver that can process the side band data, and also are subject to problems that can arise when a noise signal is introduced in the side band data, which can create unpleasant audio artifacts. In addition, attempting to transmit side band data for high frequency phase variations can create audio artifacts when low bit rate transmission processes are used.

SUMMARY OF THE INVENTION

In accordance with the present invention, a system and method for processing multi-channel audio signals to compensate magnitude data for phase data are provided that overcome known problems with converting audio data with phase and magnitude data to audio data with only magnitude data.

In particular, a system and method for processing multi-channel audio signals to compensate magnitude data for phase data are provided that eliminates the need for side band data and provides compensation for audio artifacts that can arise during the conversion process.

In accordance with an exemplary embodiment of the present invention, a system for generating parametric stereo data from phase modulated stereo data is provided. A phase difference system receives left channel data and right channel data and determines a phase difference between the left channel data and the right channel data. A phase difference weighting system receives the phase difference data and generates weighting data to adjust left channel amplitude data and right channel amplitude data based on the phase difference data. A magnitude modification system adjusts the left channel amplitude data and the right channel amplitude data using the weighting data to eliminate phase data in the left channel data and the right channel data.

The present invention provides many important technical advantages. One important technical advantage of the present invention is a system and method for processing multi-channel audio signals to compensate magnitude data for phase data that smoothes the magnitude data based on variations in phase data, so as to avoid the generation of audio artifacts that can arise when low bit rate magnitude data is adjusted to include high frequency phase variations.

Those skilled in the art will further appreciate the advantages and superior features of the invention together with other important aspects thereof on reading the detailed description that follows in conjunction with the drawings.

DETAILED DESCRIPTION OF PREFERRED EMBODIMENTS

Figure 1:
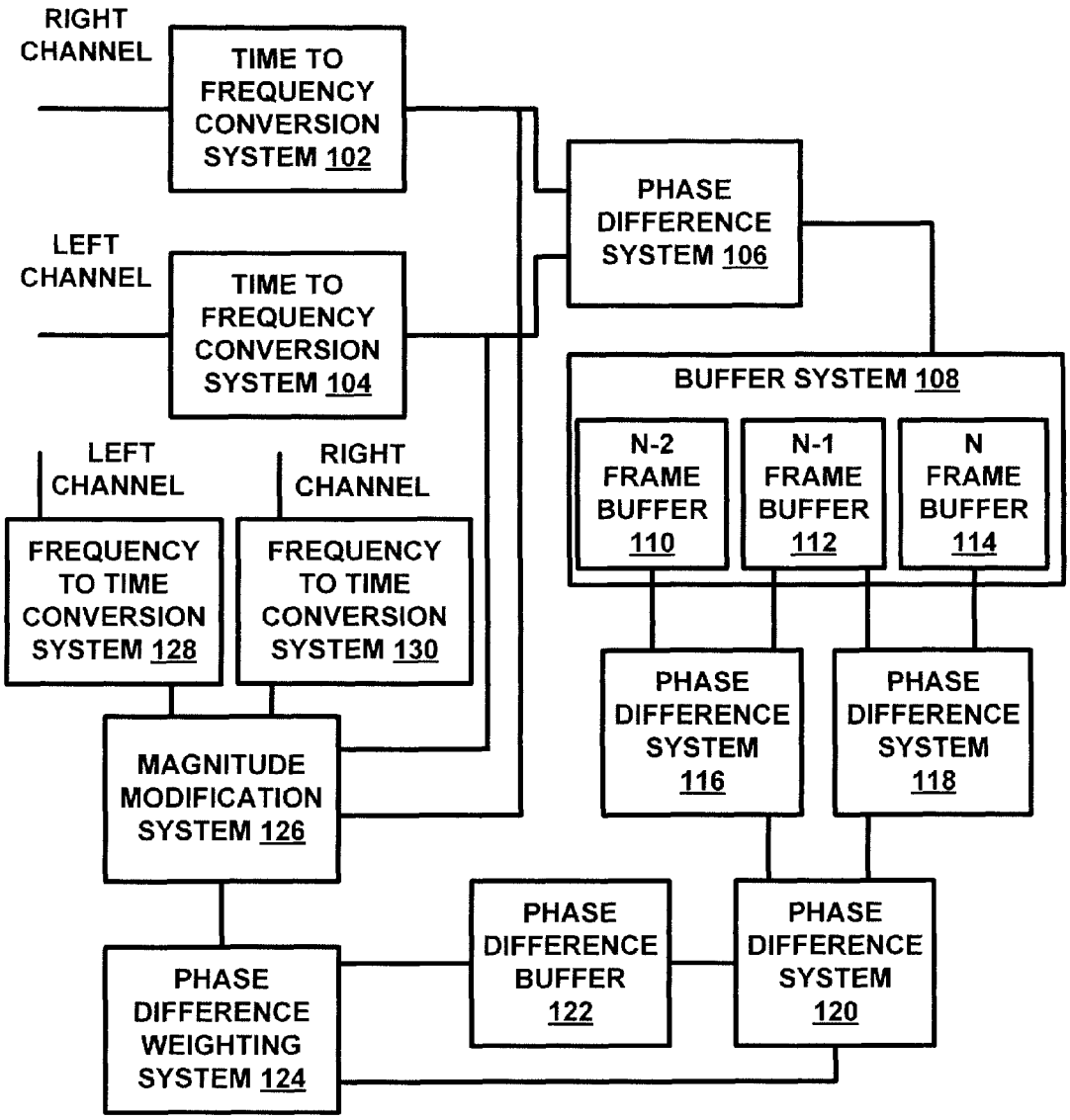
FIG. 1 is a diagram of a system for converting multi-channel audio data having both phase and magnitude data into multi-channel audio data utilizing only magnitude data, such as parametric stereo, in accordance with an exemplary embodiment of the present invention.

In the description that follows, like parts are marked throughout the specification and drawings with the same reference numerals. The drawing figures might not be to scale and certain components can be shown in generalized or schematic form and identified by commercial designations in the interest of clarity and conciseness.

FIG. 1 is a diagram of a system 100 for converting multi-channel audio data having both phase and magnitude data into multi-channel audio data utilizing only magnitude data, such as parametric stereo, in accordance with an exemplary embodiment of the present invention. System 100 identifies phase differences in the right and left channel sound data and converts the phase differences into magnitude differences so as to generate stereophonic image data using only intensity or magnitude data. Likewise, additional channels can also or alternatively be used where suitable.

System 100 receives time domain right channel audio data at time to frequency conversion system 102 and time domain left channel audio data at time to frequency conversion system 104. In one exemplary embodiment, system 100 can be implemented in hardware, software, or a suitable combination of hardware and software, and can be one or more software systems operating on a digital system processor, a general purpose processing platform, or other suitable platforms. As used herein, a hardware system can include a combination of discrete components, an integrated circuit, an application-specific integrated circuit, a field programmable gate array, or other suitable hardware. A software system can include one or more objects, agents, threads, lines of code, subroutines, separate software applications, two or more lines of code or other suitable software structures operating in two or more software applications or on two or more processors, or other suitable software structures. In one exemplary embodiment, a software system can include one or more lines of code or other suitable software structures operating in a general purpose software application, such as an operating system, and one or more lines of code or other suitable software structures operating in a specific purpose software application.

Time to frequency conversion system 102 and time to frequency conversion system 104 transform the right and left channel time domain audio data, respectively, into frequency domain data. In one exemplary embodiment, the frequency domain data can include a frame of frequency data captured over a sample period, such as 1,024 bins of frequency data for a suitable time period, such as 30 milliseconds. The bins of frequency data can be evenly spaced over a predetermined frequency range, such as 20 kHz, can be concentrated in predetermined bands such as barks, equivalent rectangular bandwidth (ERB), or can be otherwise suitably distributed.

Time to frequency conversion system 102 and time to frequency conversion system 104 are coupled to phase difference system 106. As used herein, the term "coupled" and its cognate terms such as "couples" or "couple," can include a physical connection (such as a wire, optical fiber, or a telecommunications medium), a virtual connection (such as through randomly assigned memory locations of a data memory device or a hypertext transfer protocol (HTTP) link), a logical connection (such as through one or more semiconductor devices in an integrated circuit), or other suitable connections. In one exemplary embodiment, a communications medium can be a network or other suitable communications media.

Phase difference system 106 determines a phase difference between the frequency bins in the frames of frequency data generated by time to frequency conversion system 102 and time to frequency conversion system 104. These phase differences represent phase data that would normally be perceived by a listener, and which enhance the stereophonic quality of the signal.

Phase difference system 106 is coupled to buffer system 108 which includes N−2 frame buffer 110, N−1 frame buffer 112, and N frame buffer 114. In one exemplary embodiment, buffer system 108 can include a suitable number of frame buffers, so as to store phase difference data from a desired number of frames. N−2 frame buffer 110 stores the phase difference data received from phase difference system 106 for the second previous frames of data converted by time to frequency conversion system 102 and time to frequency conversion system 104. Likewise, N−1 frame buffer 112 stores the phase difference data for the previous frames of phase difference data from phase difference system 106. N frame buffer 114 stores the current phase difference data for the current frames of phase differences generated by phase difference system 106.

Phase difference system 116 is coupled to N−2 frame buffer 110 and N−1 frame buffer 112 and determines the phase difference between the two sets of phase difference data stored in those buffers. Likewise, phase difference system 118 is coupled to N−1 frame buffer 112 and N frame buffer 114, and determines the phrase difference between the two sets of phase difference data stored in those buffers. Likewise, additional phase difference systems can be used to generate phase differences for a suitable number of frames stored in buffer system 108.

Phase difference system 120 is coupled to phase difference system 116 and phase difference system 118, and receives the phase difference data from each system and determines a total phase difference. In this exemplary embodiment, the phase difference for three successive frames of frequency data is determined, so as to identify frequency bins having large phase differences and frequency bins having smaller phase differences. Additional phase difference systems can also or alternatively be used to determine the total phase difference for a predetermined number of frames of phase difference data.

Phase difference buffer 122 stores the phase difference data from phase difference system 120 for a previous set of three frames. Likewise, if buffer system 108 includes more than three frame differences, phase difference buffer 122 can store the additional phase difference data. Phase difference buffer 122 can also or alternatively store phase difference data for additional prior sets of phase difference data, such as for the set generated from frames (N−4, N−3, N−2), the set generated from frames (N−3, N−2, N−1), the set generated from frames (N−2, N−1, N), the set generated from frames (N−1, N, N+1), or other suitable sets of phase difference data.

Phase difference weighting system 124 receives the buffered phase difference data from phase difference buffer 122 and the current phase difference data from phase difference system 120 and applies a phase difference weighting factor. In one exemplary embodiment, frequency bins exhibiting a high degree of phase difference are given a smaller weighting factor than frequency bins exhibiting consistent phase differences. In this manner, frequency difference data can be used to smooth the magnitude data so as to eliminate changes from frequency bins exhibiting high degrees of phase difference between successive frames and to provide emphasis to frequency bins that are exhibiting lower phase differences between successive frames. This smoothing can help to reduce or eliminate audio artifacts that maybe introduced by the conversion from audio data having phase and magnitude data to audio data having only magnitude data, such as parametric stereo data, particularly where low bit rate audio data is being processed or generated.

Magnitude modification system 126 receives the phase difference weighting factor data from phase difference weighting system 124 and provides magnitude modification data to the converted right channel and left channel data from time to frequency conversion system 102 and time to frequency conversion system 104. In this manner, the current frame frequency data for right and left channel audio are modified so as to adjust the magnitude to correct for phase differences, allowing panning between the left and right magnitude values to be used to create stereophonic sound. In this manner, phase differences between the right channel and left channel are smoothed and converted to amplitude modification data so as to simulate stereo or other multi-channel sound by amplitude only without requiring phase data to be transmitted. Likewise, a buffer system can be used to buffer the current frame of frequency data that is being modified, so as to utilize data from the set of (N−1, N, N+1) frames of frequency data, or other suitable sets of data. Magnitude modification system 126 can also compress or expand the differences in magnitude between two or more channels for predetermined frequency bins, groups of frequency bins, or in other suitable manners, so as to narrow or widen the apparent stage width to the listener.

Frequency to time conversion system 128 and frequency to time conversion system 130 receive the modified magnitude data from magnitude modification system 126 and convert the frequency data to a time signal. In this manner, the left channel and right channel data generated by frequency to time conversion system 128 and frequency to time conversion system 130, respectively, are in phase but vary in magnitude so as to simulate stereo data using intensity only, such that phase data does not need to be stored, transmitted or otherwise processed.

In operation, system 100 processes multi-channel audio data containing phase and magnitude data and generates multi-channel audio data with magnitude data only, so as to reduce the amount of data that needs to be transmitted to generate stereophonic or other multi-channel audio data. System 100 eliminates audio artifacts that can be created when audio data containing phase and magnitude data is converted to audio data that contains only magnitude data, by compensating the magnitude data for changes in frequency data in a manner that reduces the effect from high frequency phase changes. In this manner, audio artifacts are eliminated that may otherwise be introduced when the bit rate available for transmission of the audio data is lower than the bit rate required to accurately represent high frequency phase data.

Figure 2:
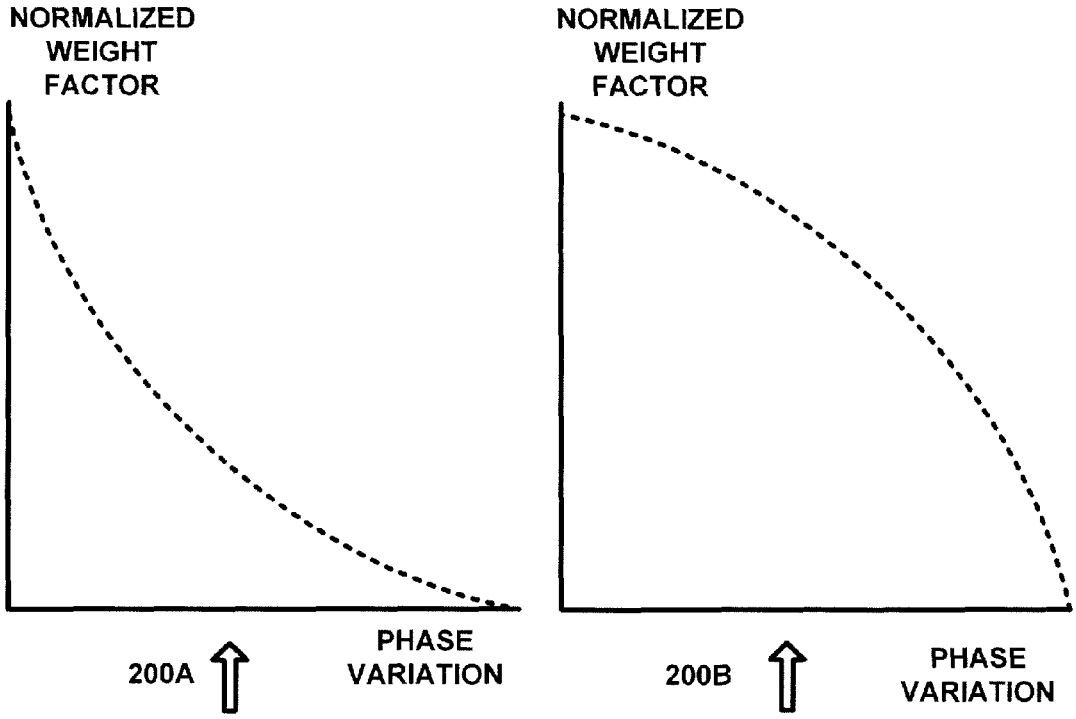
FIG. 2 is a diagram of a phase difference weighting factors in accordance with an exemplary embodiment of the present invention.

FIG. 2 is a diagram of phase difference weighting factors 200A and 200B in accordance with an exemplary embodiment of the present invention. Phase difference weighting factors 200A and 200B show exemplary normalized weighting factors to be applied to amplitude data as a function of phase variation. In one exemplary embodiment, frequency bins showing a high degree of phase variation are weighted with a lower normalized weight factor than frequency bins showing a smaller degree of phase variation, so as to smooth out potential noise or other audio artifacts that would cause parametric stereo data or other multi-channel data to improperly represent the stereo sound. In one exemplary embodiment, phase difference weighting factors 200A and 200B can be applied by a phase difference weighting system 124 or other suitable systems. The amount of weighting can be modified to accommodate the expected reduction in bit rate for the audio data. For example, when a high degree of data reduction is required, the weighting given to frequency bins exhibiting a high degree of phase variation can be reduced significantly, such as in the asymptotic manner shown in phase difference weighting factor 200A, and when a lower degree of data reduction is required, the weighting given to frequency bins exhibiting a high degree of phase variation can be reduced less significantly, such as by using phase difference weighting factor 200B.

Figure 3:
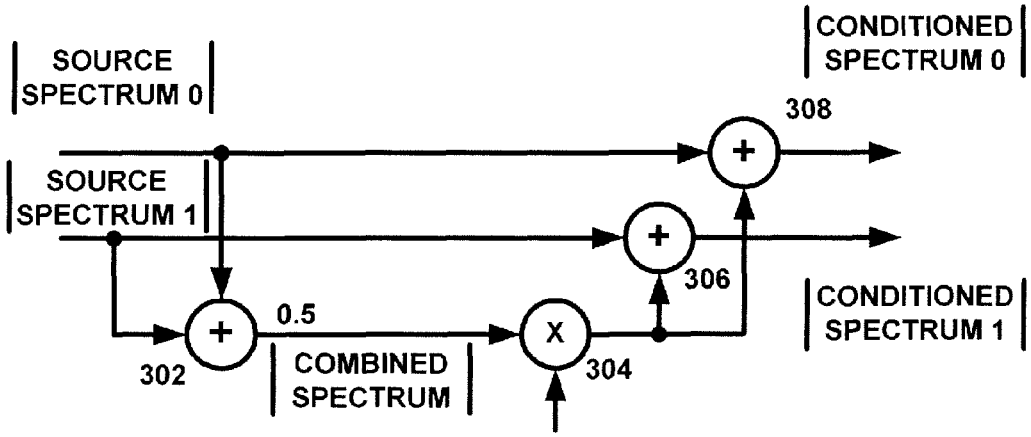
FIG. 3 is a diagram of a coherence spatial conditioning system in accordance with an exemplary embodiment of the present invention.

FIG. 3 is a diagram of a coherence spatial conditioning system 300 in accordance with an exemplary embodiment of the present invention. Coherence spatial conditioning system 300 can be implemented in hardware, software, or a suitable combination of hardware and software, and can be one or more discrete devices, one or more systems operating on a general purpose processing platform, or other suitable systems.

Coherence spatial conditioning system 300 provides an exemplary embodiment of a spatial conditioning system, but other suitable frameworks, systems, processes or architectures for implementing spatial conditioning algorithms can also or alternatively be used.

Coherence spatial conditioning system 300 modifies the spatial aspects of a multi-channel audio signal (i.e., system 300 illustrates a stereo conditioning system) to lessen artifacts during audio compression. The phase spectrums of the stereo input spectrums are first differenced by subtractor 302 to create a difference phase spectrum. The difference phase spectrum is weighted by the weighting factors $Y(K)=B_1X(K)+B_2X(K-1)-A_1Y(K-1)$ through multiplier 304, where:

| | |
|---|---|
| $Y(K)$ = | smoothed frequency bin K magnitude |
| $Y(K-1)$ = | smoothed frequency bin K-1 magnitude |
| $X(K)$ = | frequency bin K magnitude |
| $X(K-1)$ = | frequency bin K-1 magnitude |
| $B_1$ = | weighting factor |
| $B_2$ = | weighting factor |
| $A_1$ = | weighting factor; and |
| $B_1 + B_2 + A_1$ = | 1 |

The weighting factors $B_1$, $B_2$ and $A_1$ can be determined based on observation, system design, or other suitable factors. In one exemplary embodiment, weighting factors $B_1$, $B_2$ and $A_1$ are fixed for all frequency bins. Likewise, weighting factors $B_1$, $B_2$ and $A_1$ can be modified based on barks or other suitable groups of frequency bins.

The weighted difference phase signal is then divided by two and subtracted from the input phase spectrum 0 by subtractor 308 and summed with input phase spectrum 1 by summer 306. The outputs of subtractor 308 and summer 306 are the output conditioned phase spectrums 0 and 1, respectively.

In operation, coherence spatial conditioning system 300 has the effect of generating mono phase spectrum bands, such as for use in parametric stereo.

Figure 4:
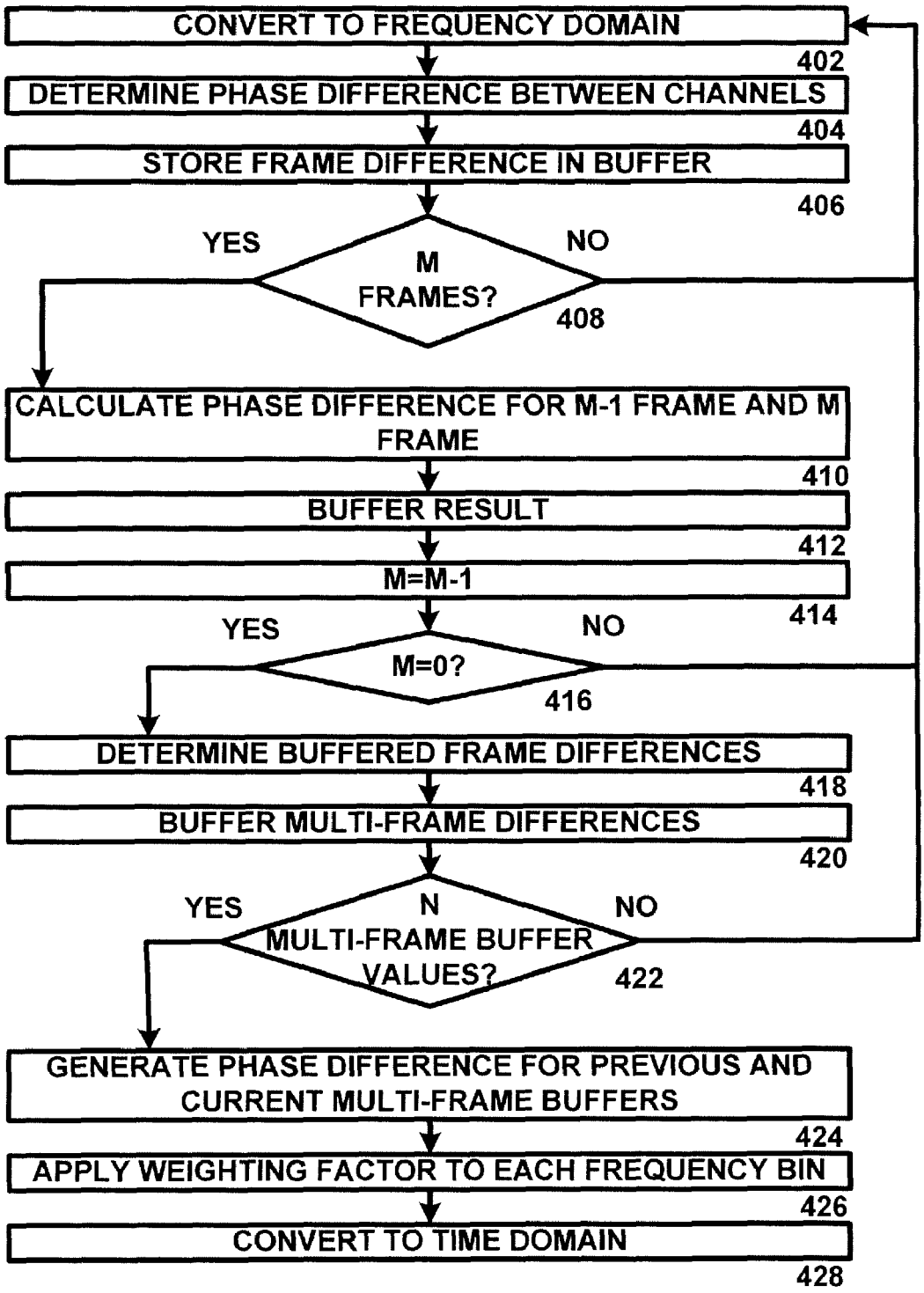
FIG. 4 is a diagram of a method for parametric coding in accordance with an exemplary embodiment of the present invention.

FIG. 4 is a diagram of a method 400 for parametric coding in accordance with an exemplary embodiment of the present invention. Method 400 begins at 402 where N channels of audio data are converted to a frequency domain. In one exemplary embodiment, left and right channel stereo data can each be converted to a frame of frequency domain data over a predetermined period, such as by using a Fourier transform or other suitable transforms. The method then proceeds to 404.

At 404, the phase differences between the channels are determined. In one exemplary embodiment, the frequency bins of left and right channel audio data can be compared to determine the phase difference between the left and right channels. The method then proceeds 406.

At 406, the phase difference data for the frames is stored in a buffer. In one exemplary embodiment, a buffer system can include a predetermined number of buffers for storing the phase difference data, buffers can be assigned dynamically, or other suitable processes can be used. The method then proceeds to 408.

At 408, it is determined whether M frames of data have been stored in the buffer. In one exemplary embodiment, M can equal three or any other suitable whole number, so as to allow smoothing to be performed between a desired number of frames. If it is determined at 408 that M frames of data have not been stored the method returns to 402. Otherwise, the method proceeds to 410.

At 410, a phase difference between the M−1 frame and M frame is determined. For example, if M equals three, then the phase difference between the second frame and the third frame of data is determined. The method then proceeds to 412 where the phase difference data is buffered. In one exemplary embodiment, a predetermined number of buffers can be created in hardware or software, buffer systems can allocate buffer data storage areas dynamically, or other suitable processes can be used. The method then proceeds to 414 where M is decreased by 1. The method then proceeds to 416 where it is determined whether M equals 0. For example, when M equals 0, then all buffered frames of data have been processed. If it is determined that M does not equal 0, the method returns to 402. Otherwise, the method proceeds to 418.

At 418, the phase difference between buffered frame phase difference data is determined. For example, if two frames of phase difference data have been stored, then the difference between those two frames is determined. Likewise, the difference between three, four, or other suitable numbers of frames of phase difference data can be used. The method then proceeds to 420, where the multi-frame difference data is buffered. The method then proceeds to 422.

At 422, it is determined whether a predetermined number of multi-frame buffer values have been stored. If it is determined that the predetermined number of multi-frame buffer values have not been stored, the method returns to 402. Otherwise the method proceeds to 424.

At 424, phase difference data for the previous and current multi-frame buffers is generated. For example, where two multi-frame buffered data values are present, the phase difference between the two multi-frame buffers is determined. Likewise, where N is greater than 2, the phase difference between the current and previous multi-frame buffers can also be determined. The method then proceeds to 426.

In 426, a weighting factor is applied to each frequency bin in the current, previous, or other suitable frames of frequency data based on the phase difference data. For example, the weighting factor can apply a higher weight to the magnitude values for frequency bins exhibiting small phase variations and can de-emphasize frequency bins exhibiting high variations so as to reduce audio artifacts, noise, or other information that represents phase data that can create audio artifacts in parametric stereo data if the phase data is discarded or not otherwise accounted for. The weighting factors can be selected based on a predetermined reduction in audio data transmission bit rate, and can also or alternatively be varied based on the frequency bin or groups of frequency bins. The method then proceeds to 428.

At 428, the weighted frequency data for the left and right channel data is converted from the frequency to the time domain. In one exemplary embodiment, the smoothing process can be performed on a current set of frames of audio data based on preceding sets of frames of audio data. In another exemplary embodiment, the smoothing process can be performed on a previous set of frames of audio data based on preceding and succeeding sets of frames of audio data. Likewise, other suitable processes can also or alternatively be used. In this manner, the channels of audio data exhibit parametric multi-channel qualities where phase data has been removed but the phase data has been converted to magnitude data so as to simulate multi-channel sound without requiring the storage or transmission of phase data, and without generation of audio artifacts that can result when the frequency of the phase variations between channels exceeds the frequency that can be accommodated by the available transmission channel bandwidth.

In operation, method 400 allows parametric stereo or other multi-channel data to be generated. Method 400 removes frequency differences between stereo or other multi-channel data and converts those frequency variations into magnitude variations so as to preserve aspects of the stereophonic or other multi-channel sound without requiring phase relationships between the left and right or other multiple channels to be transmitted or otherwise processed. In this manner, existing receivers can be used to generate phase-compensated multi-channel audio data without the need for side-band data or other data that would be required by the receiver to compensate for the elimination of the phase data.

Figure 5:
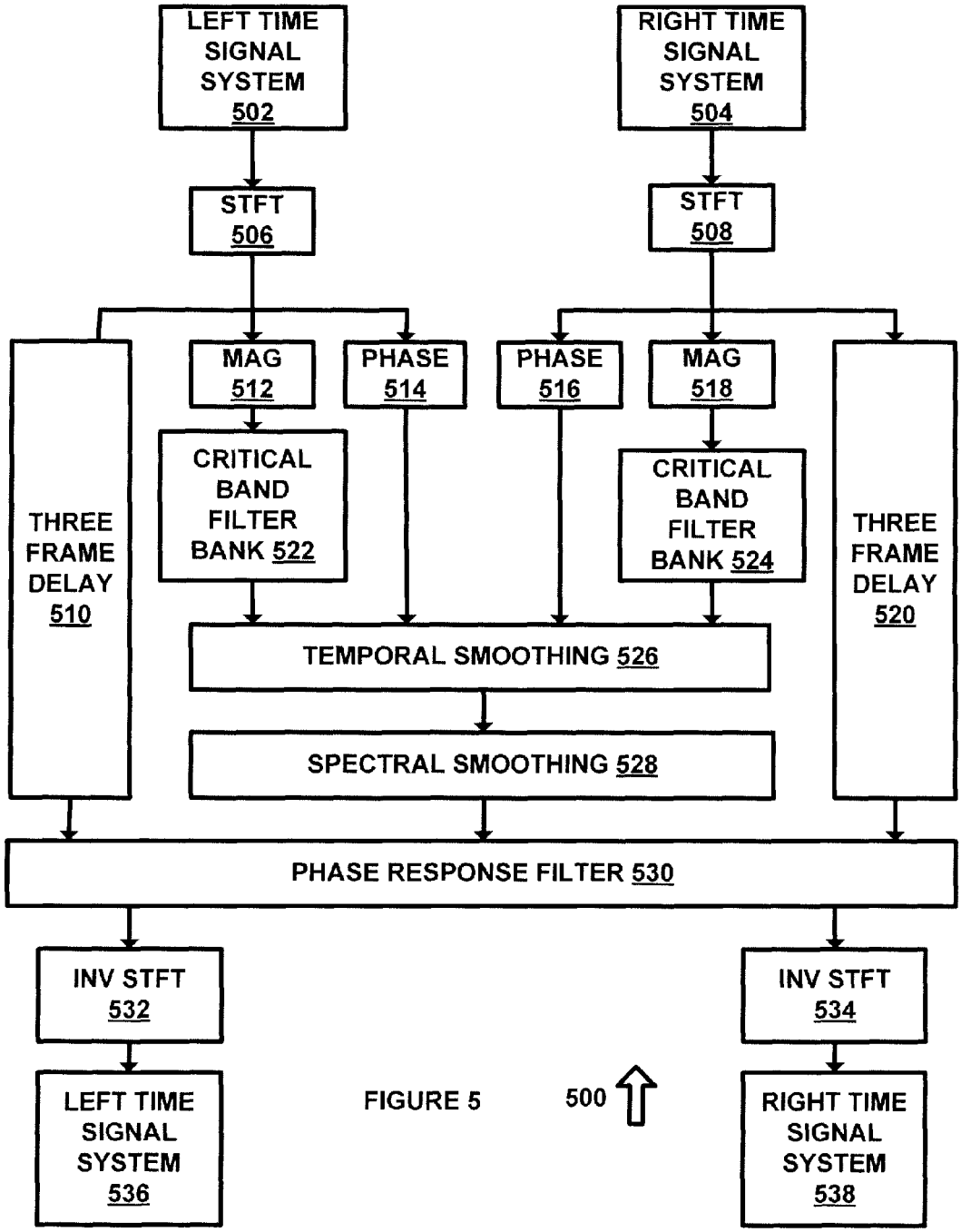
FIG. 5 is a diagram of a system for dynamic phase trend correction in accordance with an exemplary embodiment of the present invention.

FIG. 5 is a diagram of a system 500 for dynamic phase trend correction in accordance with an exemplary embodiment of the present invention. System 500 can be implemented in hardware, software or a suitable combination of hardware and software, and can be one or more software systems operating on a general purpose processing platform.

System 500 includes left time signal system 502 and right time signal system 504, which can provide left and right channel time signals generated or received from a stereophonic sound source, or other suitable systems. Short time Fourier transform systems 506 and 508 are coupled to left time signal system 502 and right time signal system 504, respectively, and perform a time to frequency domain transform of the time signals. Other transforms can also or alternatively be used, such as a Fourier transform, a discrete cosine transform, or other suitable transforms.

The output from short time Fourier transform systems 506 and 508 are provided to three frame delay systems 510 and 520, respectively. The magnitude outputs of short time Fourier transform systems 506 and 508 are provided to magnitude systems 512 and 518, respectively. The phase outputs of short time Fourier transform systems 506 and 508 are provided to phase systems 514 and 516, respectively. Additional processing can be performed by magnitude systems 512 and 518 and phase systems 514 and 516, or these systems can provide the respective unprocessed signals or data.

Critical band filter banks 522 and 524 receive the magnitude data from magnitude systems 512 and 518, respectively, and filter predetermined bands of frequency data. In one exemplary embodiment, critical filter banks 522 and 524 can group linearly spaced frequency bins into non-linear groups of frequency bins based on a psycho-acoustic filter that groups frequency bins based on the perceptual energy of the frequency bins and the human hearing response, such as a Bark frequency scale. In one exemplary embodiment, the Bark frequency scale can range from 1 to 24 Barks, corresponding to the first 24 critical bands of human hearing. The exemplary Bark band edges are given in Hertz as 0, 100, 200, 300, 400, 510, 630, 770, 920, 1080, 1270, 1480, 1720, 2000, 2320, 2700, 3150, 3700, 4400, 5300, 6400, 7700, 9500, 12000, 15500. The exemplary band centers in Hertz are 50, 150, 250, 350, 450, 570, 700, 840, 1000, 1170, 1370, 1600, 1850, 2150, 2500, 2900, 3400, 4000, 4800, 5800, 7000, 8500, 10500, 13500.

In this exemplary embodiment, the Bark frequency scale is defined only up to 15.5 kHz. As such, the highest sampling rate for this exemplary Bark scale is the Nyquist limit, or 31 kHz. A 25th exemplary Bark band can be utilized that extends above 19 kHz (the sum of the 24th Bark band edge and the 23rd critical bandwidth), so that a sampling rate of 40 kHz can be used. Likewise, additional Bark band-edges can be utilized, such as by appending the values 20500 and 27000 so that sampling rates up to 54 kHz can be used. Although human hearing generally does not extend above 20 kHz, audio sampling rates higher than 40 kHz are common in practice.

Temporal smoothing system 526 receives the filtered magnitude data from critical band filter banks 522 and 524 and the phase data from phase systems 514 and 516 and performs temporal smoothing of the data. In one exemplary embodiment, a phase delta between the left and right channels can be determined, such as by applying the following algorithm or in other suitable manners:

$$P[m,k]=\Pi X_l[m,k]-\Pi X_r[m,k]$$

where:

P=phase difference between left and right channels;

$X_l$=left stereo input signal;

$X_r$=right stereo input signal;

m=current frame; and k=frequency bin index.

A delta smoothing coefficient can then be determined, such as by applying the following algorithm or in other suitable manners:

$$\delta[m,k]=\left(\frac{|(P[m+1,k]-P[m,k])-(P[m,k]-P[m-1,k])|}{2\cdot\pi}\right)^x$$

where

δ=smoothing coefficient;

x=parameter to control the smoothing bias (typically 1, can be greater than 1 to exaggerate panning and less than 1 to reduce panning);

P=phase difference between left, right channels;

m=current frame; and k=frequency bin index.

The spectral dominance smoothing coefficients can then be determined, such as by applying the following algorithm or in other suitable manners:

$$D[m,b]=\left(\frac{C_l[m,b]}{\frac{1}{N}\sum_{b=0}^{N}C_l[m,b]}\right)\cdot\left(\frac{C_r[m,b]}{\frac{1}{N}\sum_{b=0}^{N}C_r[m,b]}\right)$$

where

D=smoothing coefficient;

C=critically banded energy (output of filter banks);

N=perceptual bands (number of filter bank bands);

m=current frame; and b=frequency band.

The phase-delta signal can then be smoothed, such as by applying the following algorithm or in other suitable manners:

$$P[m,k]=D[m,k]\cdot\delta[m,k]\cdot(P[m,k]-P[m-1,k])$$

where

δ=smoothing coefficient;

D=spectral dominance weights remapped to linear equivalent frequencies; and

P=phase difference between left and right channels.

Spectral smoothing system 528 receives the output from temporal smoothing system and performs spectral smoothing of the output, such as to reduce spectral variations that can create unwanted audio artifacts.

Phase response filter system 530 receives the output of spectral smoothing system 528 and time delay systems 510 and 520, and performs phase response filtering. In one exemplary embodiment, phase response filter system 530 can compute phase shift coefficients, such as by applying the following equations or in other suitable manners:

$$Y_l(e^{j\omega})=\cos\left(-\frac{1}{2}\angle X(e^{j\omega})\right)+j\cdot\sin\left(-\frac{1}{2}\angle X(e^{j\omega})\right)$$

$$Y_r(e^{j\omega})=\cos\left(\frac{1}{2}\angle X(e^{j\omega})\right)+j\cdot\sin\left(\frac{1}{2}\angle X(e^{j\omega})\right)$$

where $Y_l$=left channel complex filter coefficients;

$Y_r$=right channel complex filter coefficients; and

X=input phase signal.

The input signal can then be filtered, such as by applying the following algorithms or in other suitable manners:

$$H_l(e^{j\omega})=X_l(e^{j\omega})\cdot Y_l(e^{j\omega})$$

$$H_r(e^{j\omega})=X_r(e^{j\omega})\cdot Y_r(e^{j\omega})$$

where $Y_l$=left complex coefficients;

$Y_r$=right complex coefficients;

$X_l$=left stereo input signal;

$X_r$=right stereo input signal;

$H_l$=left phase shifted result; and $H_r$=right phase shifted result.

Inverse short time Fourier transform systems 532 and 534 receive the left and right phase shifted data from phase response filter system 530, respectively, and perform an inverse short time Fourier transform on the data. Other transforms can also or alternatively be used, such as an inverse Fourier transform, an inverse discrete cosine transform, or other suitable transforms.

Left time signal system 536 and right time signal system 538 provide a left and right channel signal, such as a stereophonic signal for transmission over a low bit rate channel. In one exemplary embodiment, the processed signals provided by left time signal system 536 and right time signal system 538 can be used to provide stereophonic sound data having improved audio quality at low bit rates by elimination of audio components that would otherwise create unwanted audio artifacts.

Figure 6:
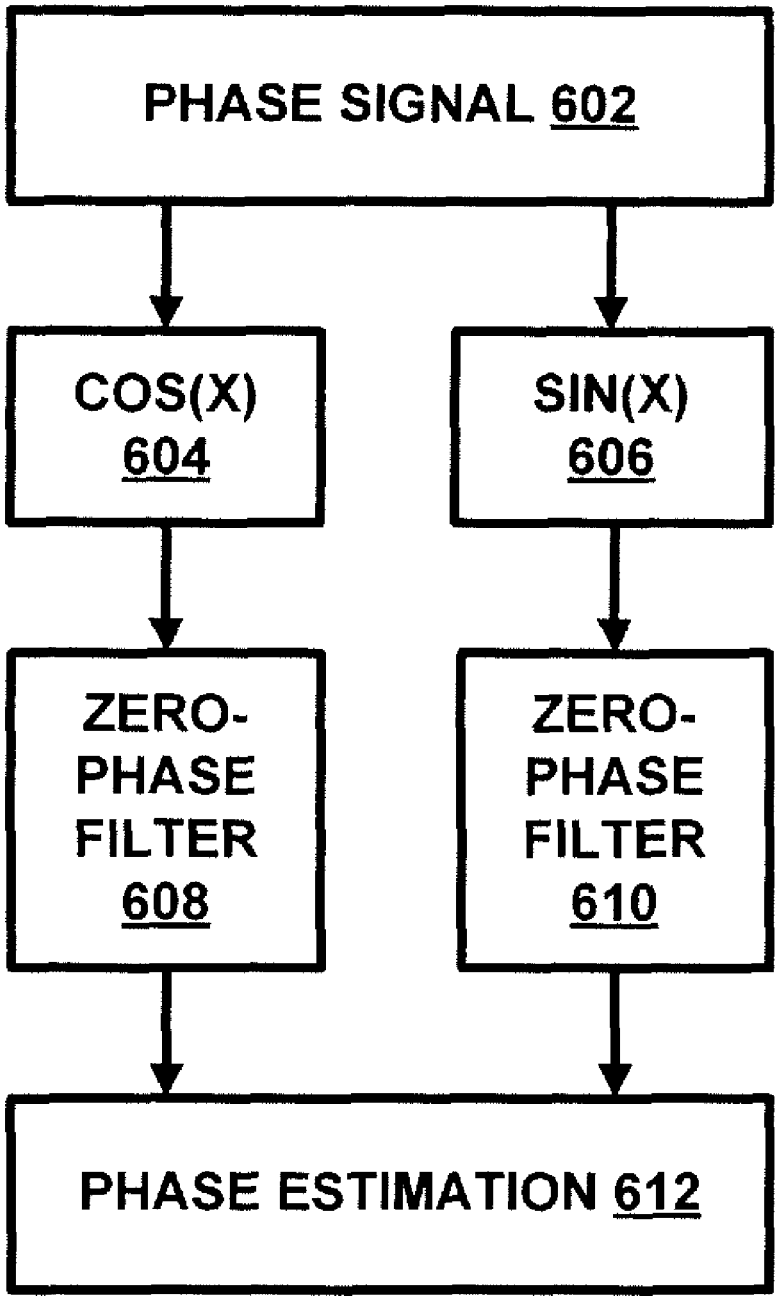
FIG. 6 is a diagram of a system for performing spectral smoothing in accordance with an exemplary embodiment of the present invention.

FIG. 6 is a diagram of a system 600 for performing spectral smoothing in accordance with an exemplary embodiment of the present invention. System 600 can be implemented in hardware, software or a suitable combination of hardware and software, and can be one or more software systems operating on a general purpose processing platform.

System 600 includes phase signal system 602, which can receive a processed phase signal, such as from temporal smoothing system 502 or other suitable systems. Cosine system 604 and sine system 606 generate cosine and sine values, respectively, of a phase of the processed phase signal. Zero phase filters 608 and 610 perform zero phase filtering of the cosine and sine values, respectively, and phase estimation system 612 receives the zero phase filtered cosine and sine data and generates a spectral smoothed signal.

In operation, system 600 receives a phase signal with a phase value that varies from π to −π, which can be difficult to filter to reduce high frequency components. System 600 converts the phase signal to sine and cosine values so as to allow a zero phase filter to be used to reduce high frequency components.

Figure 7:
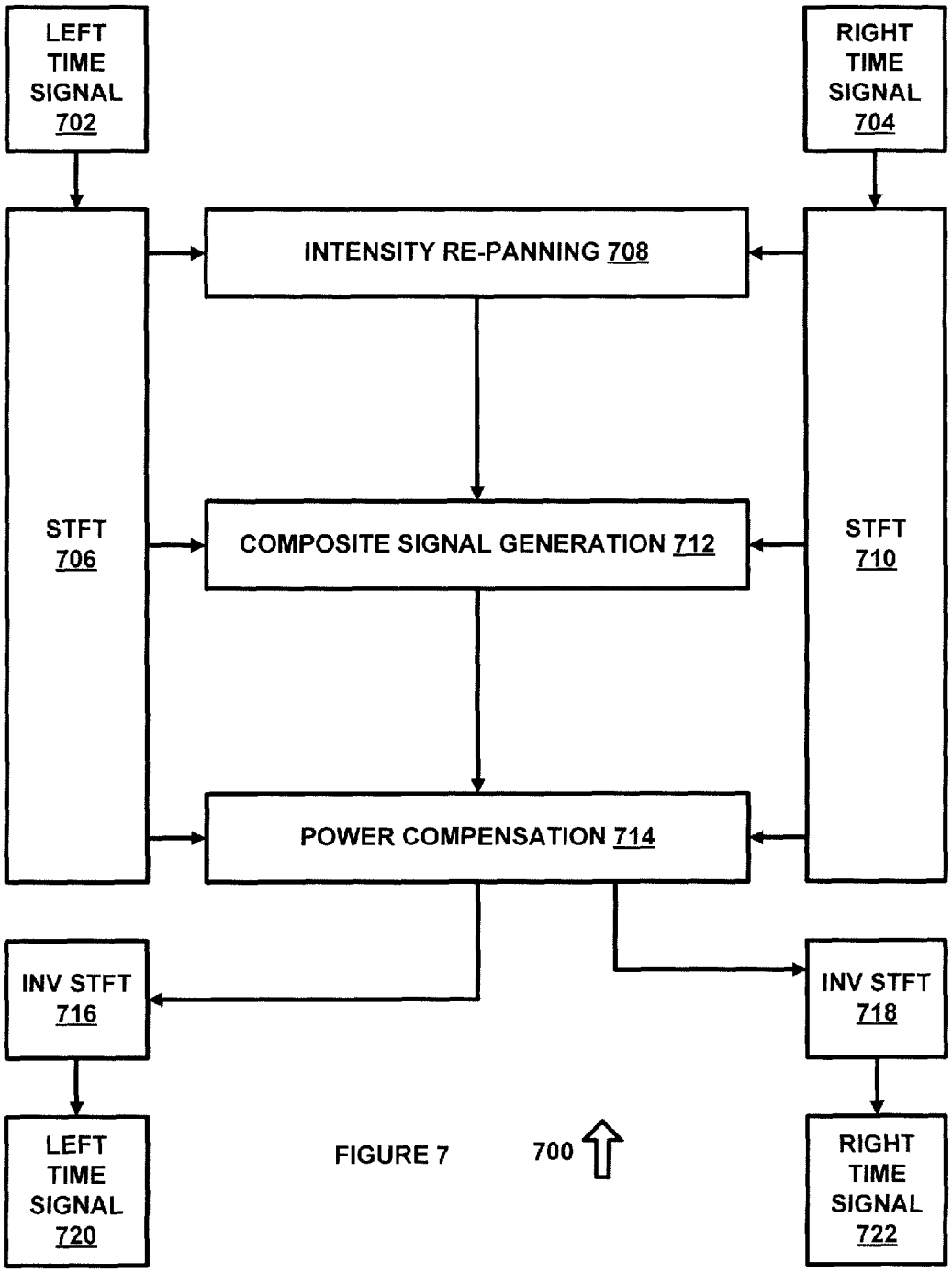
FIG. 7 is a diagram of a system for power compensated intensity re-panning in accordance with an exemplary embodiment of the present invention.

FIG. 7 is a diagram of a system 700 for power compensated intensity re-panning in accordance with an exemplary embodiment of the present invention. System 700 can be implemented in hardware, software or a suitable combination of hardware and software, and can be one or more software systems operating on a general purpose processing platform.

System 700 includes left time signal system 702 and right time signal system 704, which can provide left and right channel time signals generated or received from a stereophonic sound source, or other suitable systems. Short time Fourier transform systems 706 and 710 are coupled to left time signal system 702 and right time signal system 704, respectively, and perform a time to frequency domain transform of the time signals. Other transforms can also or alternatively be used, such as a Fourier transform, a discrete cosine transform, or other suitable transforms.

Intensity re-panning system 708 performs intensity re-panning of right and left channel transform signals. In one exemplary embodiment, intensity re-panning system 708 can apply the following algorithm or other suitable processes:

$$M_l(e^{j\omega}) = (X_l(e^{j\omega}) + X_r(e^{j\omega}))\left(\frac{|(X_l(e^{j\omega})|}{|(X_l(e^{j\omega})| + |(X_r(e^{j\omega})|}\right)^{\beta}$$

$$M_r(e^{j\omega}) = (X_r(e^{j\omega}) + X_l(e^{j\omega}))\left(\frac{|(X_r(e^{j\omega})|}{|(X_l(e^{j\omega})| + |(X_r(e^{j\omega})|}\right)^{\beta}$$

where $M_l$=left channel intensity panned signal;

$M_r$=right channel intensity panned signal;

$X_l$=left stereo input signal;

$X_r$=right stereo input signal; and

β=non-linear option to compensate for the perceived collapse of the stereo image due to the removal of phase differences between the left and right signal (typically 1, can be greater than 1 to increase panning or less than 1 to reduce panning).

Composite signal generation system 712 generates a composite signal from the right and left channel transform signals and the left and right channel intensity panned signals. In one exemplary embodiment, composite signal generation system 712 can apply the following algorithm or other suitable processes:

$$C_l(e^{j\omega})=(X_l(e^{j\omega})\cdot(1-W(e^{j\omega})))+(M_l(e^{j\omega})\cdot W(e^{j\omega}))$$

$$C_r(e^{j\omega})=(X_r(e^{j\omega})\cdot(1-W(e^{j\omega})))+(M_r(e^{j\omega})\cdot W(e^{j\omega}))$$

where $C_l$=left channel composite signal containing the original signal mixed with the intensity panned signal as determined by the frequency dependent window (W)

$C_r$=right channel composite signal containing the original signal mixed with the intensity panned signal as determined by the frequency dependent window (W)

$X_l$=left stereo input signal $X_r$=right stereo input signal $M_l$=left intensity panned signal $M_r$=right intensity panned signal W=frequency dependent window determining the mixture at different frequencies (variable bypass across frequencies; if 0, then only original signal, greater than zero (e.g. 0.5) results in mixture of original and intensity panned signal)

Power compensation system 714 generates a power compensated signal from the right and left channel transform signals and the left and right channel composite signals. In one exemplary embodiment, power compensation system 714 can apply the following algorithm or other suitable processes:

$$Y_l(e^{j\omega}) = C_l(e^{j\omega})\left(\frac{\sqrt{|X_l(e^{j\omega})|^2 + |X_r(e^{j\omega})|^2}}{|C_l(e^{j\omega})|^2 + |C_r(e^{j\omega})|^2}\right)$$

$$Y_r(e^{j\omega}) = C_r(e^{j\omega})\left(\frac{\sqrt{|X_l(e^{j\omega})|^2 + |X_r(e^{j\omega})|^2}}{|C_l(e^{j\omega})|^2 + |C_r(e^{j\omega})|^2}\right)$$

where $Y_l$=left channel power compensated signal;

$Y_r$=right channel power compensated signal;

$C_l$=left channel composite signal;

$C_r$=right channel composite signal;

$X_l$=left channel stereo input signal; and $X_r$=right channel stereo input signal.

Inverse short time Fourier transform systems 716 and 718 receive the power compensated data from power compensation system 714 and perform an inverse short time Fourier transform on the data. Other transforms can also or alternatively be used, such as an inverse Fourier transform, an inverse discrete cosine transform, or other suitable transforms.

Left time signal system 720 and right time signal system 722 provide a left and right channel signal, such as a stereophonic signal for transmission over a low bit rate channel. In one exemplary embodiment, the processed signals provided by left time signal system 720 and right time signal system 722 can be used to provide stereophonic sound data having improved audio quality at low bit rates by elimination of audio components that would otherwise create unwanted audio artifacts.

Although exemplary embodiments of a system and method of the present invention have been described in detail herein, those skilled in the art will also recognize that various substitutions and modifications can be made to the systems and methods without departing from the scope and spirit of the appended claims.

What is claimed is:

1. A system for generating parametric stereo data from phase modulated stereo data comprising:

a phase difference system receiving left channel audio data and right channel audio data and generating phase difference data based on a phase difference between left channel frequency domain data generated from the left channel audio data and right channel frequency domain data generated from the right channel audio data, wherein the left channel frequency domain data comprises left channel amplitude data and left channel phase data, and the right channel frequency domain data comprises right channel amplitude data and right channel phase data;

a phase difference weighting system receiving the phase difference data and generating weighting data to adjust the left channel amplitude data and the right channel amplitude data based on the phase difference data; and a magnitude modification system adjusting the left channel amplitude data and the right channel amplitude data using the weighting data and eliminating the left channel phase data from the left channel frequency domain data and the right channel phase data from the right channel frequency domain data.

2. The system of claim 1 wherein the phase difference weighting system receives a plurality of frames of left channel frequency domain data and right channel frequency domain data.

3. The system of claim 2 further comprising a buffer system storing the phase difference data between the left channel frequency domain data and the right channel frequency domain data for two or more corresponding frames of left channel frequency domain data and right channel frequency domain data.

4. The system of claim 1 further comprising a frequency domain to time domain conversion system receiving the left channel frequency domain data with the left channel phase data eliminated and the right channel frequency domain data with the right channel phase data eliminated from the magnitude modification system and converting the left channel frequency domain data and the right channel frequency domain data into amplitude adjusted left channel time domain data and amplitude adjusted right channel time domain data.

5. A method for generating parametric audio data from phase modulated audio data comprising:

converting a first channel audio data from a time domain signal to first channel frequency domain data, wherein the first channel frequency domain data comprises first channel amplitude data and first channel phase data;

converting a second channel audio data from a time domain signal to second channel frequency domain data wherein the second channel frequency domain data comprises second channel amplitude data and second channel phase data;

determining a phase difference between the first channel frequency domain data and the second channel frequency domain data;

determining weighting data to apply to the first channel amplitude data and the second channel amplitude data based on the phase difference between the first channel frequency domain data and the second channel frequency domain data; and adjusting the first channel amplitude data with the weighting data;

adjusting the second channel amplitude data with the weighting data;

eliminating the first channel phase data from the first channel frequency domain data; and eliminating the second channel phase data from the second channel frequency domain data.

* * * * *